US005804350A

United States Patent [19]

Sekiguchi et al.

[11] Patent Number: 5,804,350

[45] Date of Patent: Sep. 8, 1998

[54] NEGATIVELY CHARGEABLE TONER FOR DEVELOPING ELECTROSTATIC LATENT IMAGE

[75] Inventors: Yoshitaka Sekiguchi; Tetsuo Sano; Kenichi Kido, all of Amagasaki; Hiroyuki Fukuda, Kobe, all of Japan

[73] Assignee: Minolta Co., Ltd., Osaka, Japan

[21] Appl. No.: 947,907

[22] Filed: Oct. 9, 1997

[30] Foreign Application Priority Data

Mar. 4, 1997 [JP] Japan ..... 9-049126

[51] Int. Cl.[6] ..... G03G 9/097

[52] U.S. Cl. ..... 430/110; 430/111

[58] Field of Search ..... 430/110, 111

[56] References Cited

U.S. PATENT DOCUMENTS

| | | | |
|---|---|---|---|
| 4,588,668 | 5/1986 | Yasuda et al. | 430/109 |
| 4,767,688 | 8/1988 | Hashimoto et al. | 430/110 |
| 4,863,824 | 9/1989 | Uchida et al. | 430/109 |
| 5,025,067 | 6/1991 | Yamamoto et al. | 430/109 |
| 5,391,695 | 2/1995 | Kawabe et al. | 430/111 |
| 5,500,322 | 3/1996 | Tanaka et al. | 430/110 |
| 5,541,030 | 7/1996 | Sano et al. | 430/110 |
| 5,655,510 | 8/1997 | Hattori | 430/109 |
| 5,712,072 | 1/1998 | Inaba et al. | 430/111 |

FOREIGN PATENT DOCUMENTS 03112990 5/1991 Japan .

*Primary Examiner*—Roland Martin

[57] ABSTRACT

The present invention relates to a negatively chargeable toner comprising at least a binder resin, carbon black, and charge controller, wherein said charge controller is a colorless or white in color boron compound, and wherein a melt viscosity curve of said negatively chargeable toner has an inflection point of a viscosity slope, an inflection point temperature ($T_2$) existing within a temperature range of $T_1$+20° C. to $T_1$+40° C. relative to a flow start temperature ($T_1$), a first absolute value ($\Delta\eta_1$) existing within a range of $4.0\times10^{-2}$ to $6.0\times10^{-2}$, said first absolute value. ($\Delta\eta_1$) being a mean viscosity slope within a temperature range below the inflection point temperature ($T_2$), a second absolute value ($\Delta\eta_2$) existing less than $2.0\times10^{-2}$, said second absolute value ($\Delta\eta_2$) being a mean viscosity slope within a temperature range higher than said inflection point temperature ($T_2$) is less than $2.0\times10^{-2}$, and a temperature difference between said inflection point temperature ($T_2$) and a flow stop temperature ($T_3$) being 5° C. or more.

27 Claims, 4 Drawing Sheets

NEGATIVELY CHARGEABLE TONER FOR DEVELOPING ELECTROSTATIC LATENT IMAGE

BACKGROUND OF THE INVENTION

1. Field of the Invention

The present invention relates to a toner for developing electrostatic latent images, and specifically relates to a negatively chargeable toner for use in digital type image forming apparatuses.

2. Description of the Related Art

Conventional image forming apparatuses are generally analog type image forming apparatuses such as used in copiers and the like wherein a document is illuminated by a light source and the light reflected from said document irradiates the surface of a photosensitive member so as to form an electrostatic latent image on the surface of said photosensitive member. Image forming apparatuses of the digital type are known wherein digitally written electrostatic latent image is developed by supplying a developer containing a toner to said latent image. Digital type image forming apparatuses have been practicalized in the forms of electrophotographic type facsimile apparatuses, digital copiers which form images based on image information read by an image reader, and printers using the output of computer terminals.

In image forming apparatuses of the digital type, an electrostatic latent image is formed in dot units on the surface of a negatively charged organic photosensitive member by digitally writing image data via irradiation of said surface by a laser beam or the like, this latent image is reverse developed by a negatively charged toner, and the obtained toner image is transferred onto a recording member and fused thereon to form a recorded image. The toner used in such digital type processes must have excellent dot reproducibility. That is, the toner must have a true reproducibility in dot units when developing an electrostatic latent image formed on the surface of a photosensitive member, and this reproducibility must not be reduced even after repeated use. To satisfy such characteristics, a toner must have excellent charge rise characteristics as well as excellent stability relative to charging. In the case of two-component developers, a toner is mixed with a carrier within the developing device so as to be triboelectrically charged; the toner must have charging characteristics such that a desired amount of charge is attained rapidly in a short mixing time, but thereafter the charge amount drops somewhat or does not increase even with additional mixing.

Known art for improving the negative charging characteristics of a toner is the addition of various negative charge controller agents. Negative charge controllers have different charging characteristics depending on the type of controller, and many are known to increase the amount of negative charge of a toner, such that simply adding a charge controller does not produce the aforesaid excellent charging stability.

SUMMARY AND OBJECTS OF THE INVENTION

An object of the present invention is to eliminate the previously described disadvantages by providing a negatively chargeable toner having excellent chargeability and excellent dot reproducibility.

Another object of the present invention is to provide a negatively chargeable toner having the aforesaid excellent charging characteristics and excellent black color reproducibility.

A further object of the present invention is to provide a negatively chargeable toner which is resistant to dot breakdown under heat-fixing, and which eliminates the problem of reduced image quality incurred by heat-fixing.

The negatively chargeable toner of the present invention comprises:

a binder resin;

carbon black, and boron compound having the structural formula (A) below,

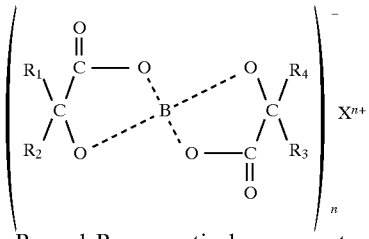

(A)

(Wherein $R_1$ and $R_3$ respectively represent substituted or non-substituted aryl group, $R_2$ and $R_4$ respectively represent hydrogen atom, alkyl group, substituted or non-substituted aryl group, and X represents a cation. In the equation, n is an integer of either 1 or 2.)

Wherein a melt viscosity curve of said negatively chargeable toner has an inflection point of a viscosity slope, an inflection point temperature ($T_2$) existing within a temperature range of $T_1$+20° C. to $T_1$+40° C. relative to a flow start temperature ($T_1$), a first absolute value ($\Delta\eta_1$) existing within a range of $4.0\times10^{-2}$ to $6.0\times10^{-2}$, said first absolute value ($\Delta\eta_1$) being a mean viscosity slope within a temperature range below the inflection point temperature ($T_2$), a second absolute value ($\Delta\eta_2$) existing less than $2.0\times10^{-2}$, said second absolute value ($\Delta\eta_2$) being a mean viscosity slope within a temperature range higher than said inflection point temperature ($T_2$) is less than $2.0\times10^{-2}$, and a temperature difference between said inflection point temperature ($T_2$) and a flow stop temperature ($T_3$) being 5° C. or more.

DESCRIPTION OF THE PREFERRED EMBODIMENTS

Figure 1:
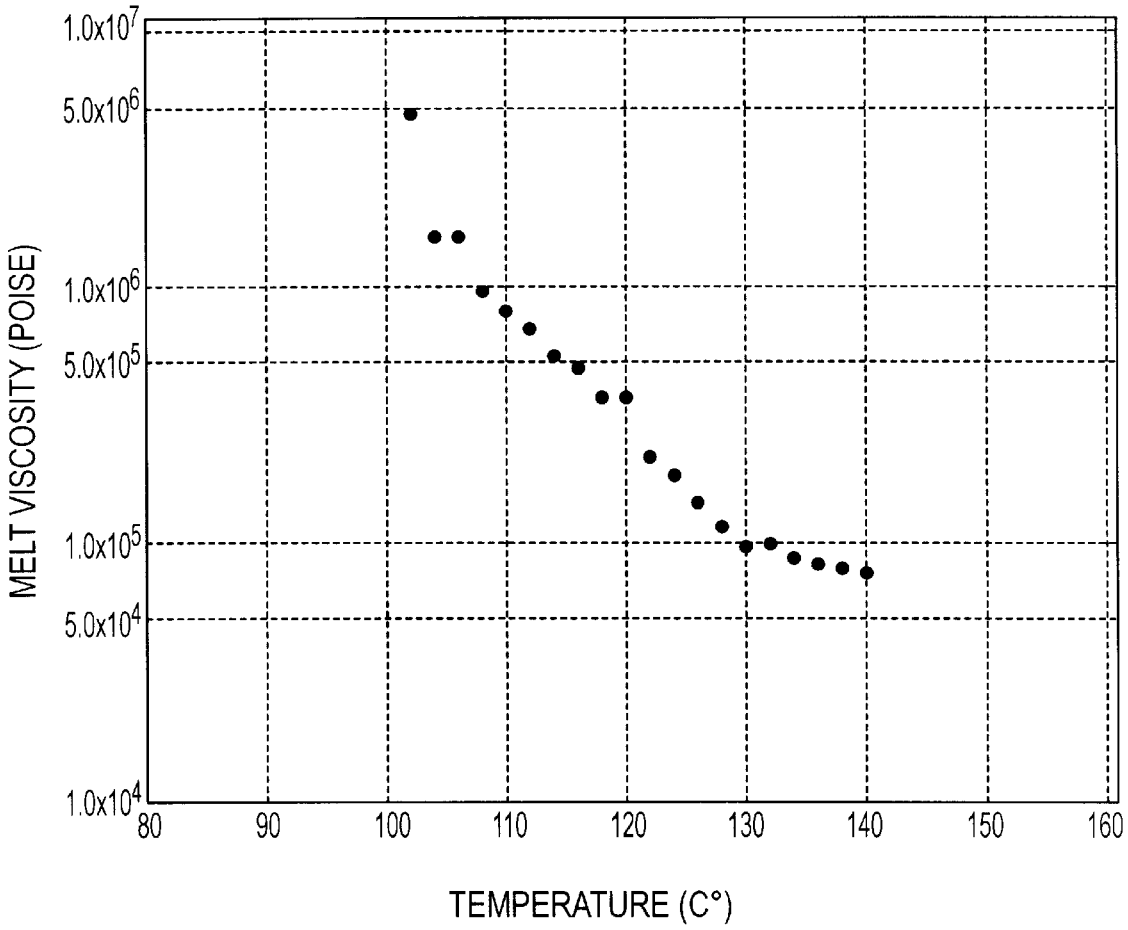
FIG. 1 shows the melt viscosity curve of a first embodiment of the toner.

The present invention relates to a negatively chargeable toner comprising at least a binder resin, carbon black, and charge controller, wherein said charge controller is a boron compound the structural formula (A) below:

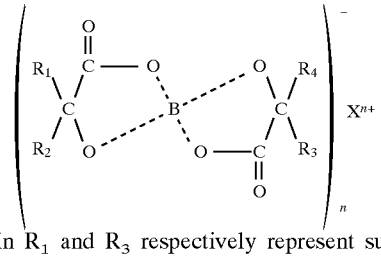

(A)

(Wherein $R_1$ and $R_3$ respectively represent substituted or non-substituted aryl group, $R_2$ and $R_4$ respectively represent hydrogen atom, alkyl group, substituted or non-substituted aryl group, and X represents a cation. In the equation, n is an integer of either 1 or 2.), and wherein a melt viscosity curve of said negatively chargeable toner has an inflection point of a viscosity slope, an inflection point temperature ($T_2$) existing within a temperature range of $T_1$+20° C. to $T_1$+40° C. relative to a flow start temperature ($T_1$), a first absolute value ($\Delta\eta_1$) existing within a range of $4.0\times10^{-2}$ to $6.0\times10^{-2}$, said first absolute value ($\Delta\eta_1$) being a mean viscosity slope within a temperature range below the inflection point temperature ($T_2$), a second absolute value ($\Delta\eta_2$) existing less than $2.0\times10^{-2}$, said second absolute value ($\Delta\eta_2$) being a mean viscosity slope within a temperature range higher than said inflection point temperature ($T_2$) is less than $2.0\times10^{-2}$, and a temperature difference between said inflection point temperature ($T_2$) and a flow stop temperature ($T_3$) being 5° C. or more.

The negatively chargeable toner of the present invention includes a boron compound having the aforesaid structural formula (A) to improve the charge stability and charge rise characteristics. Excellent effectiveness exceeding that described above can be obtained by including a boron compound in the toner containing specific binder resin described later. That is, a toner having excellent negative charging characteristics before inclusion of a boron compound may be used to obtain a high amount of negative charge. On the other hand, it is believed that the aforesaid excellent charging stability can be obtained by including the aforesaid boron compound to the aforesaid toner which characteristically exhibits an increase in the amount of charge when excessively mixed. The previously mentioned boron compound represented by the structural formula (A) does not contain any heavy metals and has excellent safety property.

Examples of usable cations represented by X in the aforesaid structural formula (A) include alkali metal ions such as lithium, potassium and the like, alkali earth metal ions such as magnesium, calcium and the like, hydrogen ion, ammonium ion, iminium ion, phosphonium ion and the like. The aforesaid boron compound is desirably added at a rate of 0.5 to 5 parts-by-weight, and preferably 1 to 3 parts-by-weight relative to 100 parts-by-weight (hereinafter parts-by-weight abbreviated to pbw)of binder resin. When the added amount of boron compound is less than 0.5 pbw, inadequate effectiveness is achieved, whereas when the added amount is in excess of 5 pbw, the amount of toner charge is reduced, causing the carrier to become spent too quickly when used in two-component developers.

Boron compounds possessing excellent characteristics will be colorless or white in color and, therefore disadvantageously reduce the degree of blackness of black toners. For example, the degree of blackness of the toner is reduced when using the aforesaid boron compound in place of azo compounds containing heavy metals such as chrome and cobalt and the like which are normally used as negative charge controllers because their color is black or a near-black dark color. In the present invention, toner having a specific melt viscosity characteristic is used to resolve the aforesaid disadvantage. Specifically, a toner is used wherein the melt viscosity curve of said toner, when measured via a flow tester, has an inflection point of a viscosity slope, an inflection point temperature ($T_2$) existing within a temperature range of $T_1$+20° C. to $T_1$+40° C. relative to a flow start temperature ($T_1$), a first absolute value ($\Delta\eta_1$) existing within a range of $4.0\times10^{-2}$ to $6.0\times10^{-2}$, said first absolute value ($\Delta\eta_1$) being a mean viscosity slope within a temperature range below the inflection point temperature ($T_2$), a second absolute value ($\Delta\eta_2$) existing less than $2.0\times10^{-2}$, said second absolute value ($\Delta\eta_2$) being a mean viscosity slope within a temperature range higher than said inflection point temperature ($T_2$) is less than $2.0\times10^{-2}$, and a temperature difference between said inflection point temperature ($T_2$) and a flow stop temperature ($T_3$) being 5° C. or more, and preferably 8° C. or more. That is, the toner having the aforesaid melt viscosity characteristics will have unreduced melt viscosity in the high temperature range above the aforesaid inflection point temperature ($T_2$). Therefore, the black color of an image is improved by forming a suitably rough surface on the fixed image obtained by heat-fixing of the toner. Thus, melt breakdown of the toner does not readily occur even under heat and pressure fixing due to the aforesaid melt viscosity characteristics, and high resolution image reproducibility is improved when reproducing images using a digital image forming apparatus.

A desirable toner from the perspectives mentioned above as well as fixing characteristics will have a first melt viscosity at the inflection point temperature ($T_2$) within the range of $7.5\times10^4$ to $5.0\times10^5$ poise, preferably $8.0\times10^4$ to $3.0\times10^5$ poise, and more preferably $1.0\times10^5$ to $2.0\times10^5$ poise, and a second melt viscosity of the toner in the high temperature range above said inflection point temperature ($T_2$) will be within the range of $5.0\times10^4$ to $2.0\times10^5$ poise, and preferably $7.5\times10^4$ to $1.5\times10^5$ poise.

In the present invention, the aforesaid melt viscosity characteristics were measured using a flow tester (model CFT-500; Shimazu Seisakusho), with a melt flow of a 1 $cm^3$ sample under conditions of die pore 1 mm diameter by 1 mm length, 10 $kg/cm^2$ pressure, and temperature elevation rate of 3° C./min.

The toner of the present invention desirably uses a polyester resin having an acid value of 5 to 50 KOHmg/g as the main component of the binder resin. Use of a polyester resin having such an acid value improves the dispersibility of colorant and boron compound, and produces a toner having sufficient negative charge. When the acid value is less than 5 KoHmg/g, the effectiveness is markedly reduced, and when the acid value exceeds 50 KoHmg/g, the stability of the toner charge amount is adversely affected by environmental fluctuations, especially temperature fluctuations.

The polyester resin used in the present invention may be a polyester resin obtained by condensation polymerization of a polyvalent alcohol component and polyvalent carboxylic acid component.

Examples of useful bivalent alcohol components among the aforesaid polyvalent alcohol components include bisphenol-A alkylene oxide adducts such as polyoxypropylene(2,2)-2,2-bis(4-hydroxyphenyl)propane, polyoxypropylene (3,3)-2,2-bis(4-hydroxyphenyl)propane, polyoxypropylene(6)-2,2-bis(4-hydroxyphenyl)propane, polyoxyethylene(2,0)-2,2-bis(4-hydroxyphenyl)propane and the like, ethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polytetramethylene glycol, bisphenol-A, bisphenol-A with added hydrogen and the like.

Examples of useful trivalent and above alcohol components include sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene and the like.

Examples of useful bivalent carboxylic acid components among the aforesaid polyvalent carboxylic acid component include maleic acid, fumaric acid, citraconic acid, itaconic acid, glutamic acid, phthalic acid, isophthalic acid, terephthalic acid, cyclohexane dicaroboxylic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, isooctenylsuccinic acid, n-octylsuccinic acid, isooctylsuccinic acid, and acid anhydrides or low-molecular alkyl esters thereof.

Examples of useful trivalent and above carboxylic acid components include 1,2,4-benzenetricarboxylic acid (trimellitic acid), 1,2,5-benzenetricarboxylic acid, 2,5,7-naphthalenetricarboxylic acid, 1,2,4-napthalenetricarboxylic acid, 1,2,4-butanetricarboxylic acid, 1,2,5-hexanetricarboxylic acid, 1,3-dicarboxyl-2-methyl-2-methylenecarboxy propane, 1,2,4-cyclohexanetricarboxylic acid, tetra(methylecarboxyl)methane, 1,2,7,8-octane tetracarboxylic acid, pyromellitic acid, empol trimer acid, and acid anhydrides and low-molecular alkyl esters thereof.

The binder resin used in the present invention may be a resin obtained by parallel reactions in the same vessel comprising radical polymerization reaction of vinyl resin and condensation polymerization reaction of a polyester resin using a raw monomer of polyester resin, raw monomer of vinyl resin and a dual-reactive monomer. The dual-reactive monomer can use the dual reactions of the condensation polymerization and the radical polymerization. That is, the dual-reactive monomer has a carboxy group for the condensation polymerization reaction and a vinyl group for the radical polymerization reaction, e.g., fumaric acid, maleic acid, acrylic acid, methacrylic acid and the like.

The raw monomers of the polyester resin may have the aforesaid polyvalent alcohol component and polyvalent carboxylic acid component.

Examples of useful raw monomers of vinyl resin include styrene or styrene derivatives such as styrene, o-methylstyrene, m-methylstyrene, p-methylstyrene, α-methylstyrene, p-ethylstyrene, 2,4-dimethylstyrene, p-tert-butylstyrene, p-chlorostyrene and the like; ethylene unsaturated monoolefins such as ethylene, propylene, butylene, isobutylene and the like; alkyl ester methacrylates such as methylmethacrylate, n-propylmethacrylate, isopropylmethacrylate, n-butylmethacrylate, isobutylmethacrylate, t-butylmethacrylate, n-pentylmethacrylate, isopentylmethacrylate, neopentylmethacrylate, 3-(methyl)butylmethacrylate, hexylmethacrylate, octylmethacrylate, nonylmethacrylate, decylmethacrylate, undecylmethacrylate, dodecylmethacrylate and the like; alkyl ester acrylates such as methylacrylate, n-propylacrylate, isopropylacrylate, n-butylacrylate, isobutylacrylate, t-butylacrylate, n-pentylacrylate, isopentylacrylate, neopentylacrylate, 3-(methyl) butylacrylate, hexylacrylate, octylacrylate, nonylacrylate, decylacrylate, undecylacrylate, dodecylacrylate and the like; and acrylonitile, maleic acid ester, itaconic acid ester, vinylchloride, vinyl acetate, vinylbenzoate, vinylmethylethyl ketone, vinylhexyl ketone, vinylmethyl ether, vinylethyl ether, vinylisobutyl ether and the like. Examples of useful polymerization initiators when polymerizing the raw monomers of vinyl resin include azo and diazo polymerization initiators such as 2,2'-azobis(2,4-dimethylvaleronitrile, 2,2'-azobisisobutylonitrile, 1,1'-azobis(cyclohexane-1-carbonitrile), 2,2'-azobis-4-methoxy-2,4-dimethylvaleronitrile and the like; and peroxide polymerization initiators such as benzoylperoxide, methylethylketone peroxide, isopropyl peroxycarbonate, lauroyl peroxide and the like.

In the present invention, the previously mentioned polyester resins may be used individually or in combinations. The acid value of the resin is the value calculated from the uptake of a N/10 sodium hydroxide/alcohol solution by titrating a previously standardized N/10 sodium hydroxide/alcohol solution using 0.1% bromothymol blue and phenol red mixed indicator with 10 mg of sample material dissolved in 50 ml toluene.

In the present invention, carbon black is used as a colorant; the amount of carbon black used is desirably 6 to 12 pbw, and preferably 7 to 10 pbw, relative to 100 pbw of binder resin. When the carbon lack content is less than 6 pbw, the toner has insufficient degree of blackness even though it has the aforesaid melt viscosity characteristics. When the carbon black content exceeds 12 pbw, the toner charge is reduced, thereby readily causing the disadvantages of toner fog and spillage. From the perspective of safety, the carbon black used will have a mean primary particle size of 40 nm or less, and preferably 10 to 40 nm, and more preferably 15 to 35 nm.

When using the aforesaid polyester resin as a binder resin, it is desirable to use an acidic carbon black having a pH value of 1~6 to improve dispersibility.

A wax may be added to the toner of the present invention to improve anti-offset characteristics and the like. Examples of useful waxes include polyethylene wax, polypropylene wax, carnuba wax, rice wax, sasol wax, montan wax, fischer-tropsch wax. When such wax is included in the toner, the wax content is desirably 0.5 to 5 pbw relative to 100 pbw of binder resin to achieve effectiveness in preventing filming and the like.

It is desirable to include polypropylene wax in the toner from the perspective of improving anti-offset characteristics. It is further desirable to include polyethylene wax in the toner from the perspective of improving smear characteristics (i.e., smearing occurs when is blurred or soiled by a roller when fed by an autofeeder or when making a duplex copy with an image already formed on one side of the sheet). A particularly desirable polypropylene wax, from the aforesaid perspectives, will have a melt viscosity of 50~300 cps at 160° C., softening point of 130°~160° C., and acid value of 1~20 KOHmg/g. A particularly desirable polyethylene wax will have a melt viscosity of 1,000~8,000 cps at 160° C., and softening point of 130°~150° C. That is, A polypropylene wax having the aforesaid melt viscosity, softening point, and acid value has excellent dispersibility relative to a binder resin, and improves anti-offset characteristics without the problems associated with free wax. A polyethylene wax having the aforesaid melt viscosity and softening point has excellent dispersibility relative to a binder resin, and improves smear characteristics by reducing the friction coefficient of the fixed image surface without the problems associated with free wax. The wax melt viscosity was measured using a Brookfield viscometer.

Magnetic powder or the like may be added to the toner of the present invention as necessary. Examples of useful magnetic powders include well-known fine magnetic particles such as ferrite, magnetite, iron and the like, and may be added from the perspective of preventing airborne dispersion of the toner; The amount of added magnetic powder is desirable 0.5 to 10 pbw, preferably 0.5 to 8 pbw, and more preferably 1 to 5 pbw, relative to 100 pbw of binder resin. When the amount of added magnetic powder exceeds 10 pbw, developing characteristics are reduced due to the strengthening of the magnetic flux force exerted y the developer carrying member (within the magnet roller) on the toner.

The toner of the present invention may have an exterior coating of inorganic microparticles on its surface. The toner and inorganic microparticles may be subjected to mechanical mixing to achieve the surface coating. Examples of useful inorganic microparticles include silica particles, titanium dioxide particles, alumina particles, magnesium fluoride particles, silicon carbide particles, boron carbide particles, titanium carbide particles, zirconium carbide particles, boron nitride particles, titanium nitride particles, zirconium nitride particles, magnetite particles, molybdenum disulfide particles, barium titanate particles, strontium titanate particles, aluminum stearate particles, magnesium stearate particles, zinc stearate particles and the like used individually or in combinations of two or more. It is desirable that silica particles and titanium dioxide particles are used in combination for the exterior coating process. The amount of added inorganic microparticles is desirably 0.05~2 percent-by-weight, and preferably 0.1~1 percent-by-weight relative to the toner. The addition of the inorganic microparticles in the aforesaid amount improves flow characteristics without loss of environmental stability of the developer. Furthermore, it is desirable from the perspective of improved environmental stability that the aforesaid inorganic microparticles are subjected to hydrophobic processing using, for example, silane coupling agent, titanium coupling agent, higher fatty acids, silicone oil and the like. It is desirable that the aforesaid inorganic microparticles have a BET specific surface area of 80~180 $m^2/g$. The use of inorganic microparticles having the aforesaid BET specific surface area improves flow characteristics by allowing an increased amount of additive without loss of environmental stability compared to the use of inorganic microparticles having a BET specific surface area of 200 $m^2/g$ or higher relative to the fine toner particles having a mean particle size of 5~9 $\mu$m which reduce flow characteristics. Not only are flow characteristics improved, but also dot reproducibility is improved by improving the transfer characteristics when transferring a toner image formed on the surface of a photosensitive member to a recording medium such as a recording sheet or the like.

The toner of the present invention may be used in a two-component developer together with a carrier, or in a monocomponent developer without a carrier. The carrier used in a two-component developer may be a well-known conventional carrier.

The present invention is described by way of examples below, but is not limited to these examples.

Production of Polyester Resin L1

Polyoxypropylene(2,2)-2,2-bis(4-hydroxyphenyl) propane, polyoxyethylene(2,2)-2,2-bis(4-hydroxyphenyl) propane, anhydrous isododecenylsuccinic acid, terephthalic acid, and fumaric acid were combined to achieve a weight ratio of 82:77:16:32:30. The mixture was introduced into a four-mouth flask to which a reflux condenser, nitrogen gas tube, thermometer, and mixing device were attached, then dibutyl tin oxide was added as a polymerization initiator. The material was heated in a mantle heater under a nitrogen atmosphere and reacted by mixing at 220° C. The obtained polyester resin L1 had a softening point of 110° C., glass transition temperature of 60° C., and acid value of 17.5 KOHmg/g.

Production of Polyester Resin L2

Polyoxypropylene(2,2)-2,2-bis(4-hydroxyphenyl) propane, polyoxyethylene(2,2)-2,2-bis(4-hydroxyphenyl) propane, terephthalic acid, and anhydrous 1,2,4-benzenetricarboxylic acid were combined to achieve a weight ratio of 73:30:45:3. The mixture was introduced into a four-mouth flask to which a reflux condenser, nitrogen gas tube, thermometer, and mixing device were attached, then dibutyl tin oxide was added as a polymerization initiator. The material was heated in a mantle heater under a nitrogen atmosphere and reacted by mixing at 220° C. The obtained polyester resin L2 had a softening point of 111.5° C., glass transition temperature of 70° C., and acid value of 19.3 KOHmg/g.

Production of Polyester Resin H1

Styrene and 2-ethylhexylacrylate were combined at a weight ratio of 17:3.2, and dicumyl peroxide was introduced via a titration rod as a polymerization initiator. Polyoxypropylene(2,2)-2,2-bis(4-hydroxyphenyl) propane, polyoxyethylene(2,2)-2,2-bis(4-hydroxyphenyl) propane, anhydrous isododecenylsuccinic acid terephthalic acid, anhydrous 1,2,4-benzenetricarboxylic acid, and acrylic acid were combined to achieve a weight ratio of 742:11:11:11:8:1, and the mixture was introduced into a four-mouth flask to which a reflux condenser, nitrogen gas tube, thermometer, and mixing device were attached, then dibutyl tin oxide was added as a polymerization initiator. The material was mixed in a mantle heater under a nitrogen atmosphere at 135° C. as the styrene/2-ethylhexylacrylate solution was titrated in via the titration rod, and thereafter the temperature was elevated and the materials were reacted at 230° C. The obtained polyester resin H1 had a softening point of 150° C., glass transition temperature of 62° C., and acid value of 24.5 KOHmg/g.

Production of Polyester Resin H2

Polyoxypropylene(2,2)-2,2-bis(4-hydroxyphenyl) propane, polyoxyethylene(2,2)-2,2-bis(4-hydroxyphenyl) propane, anhydrous isododecenylsuccinic acid, terephthalic acid, and anhydrous 1,2,4-benzenetricarboxylic acid were combined to achieve a weight ratio of 73:30:18:25:3. The mixture was introduced into a four-mouth flask to which a reflux condenser, nitrogen gas tube, thermometer, and mixing device were attached, then dibutyl tin oxide was added as a polymerization initiator. The material was heated in a mantle heater under a nitrogen atmosphere and reacted by mixing at 220° C. The obtained polyester resin H2 had a softening point of 154° C., glass transition temperature of 64° C., and acid value of 20.4 KOHmg/g.

The softening point was determined using a flow tester (model CFT-500; Shimazu Seisakusho); The softening point was designated as the temperature corresponding to ½ the height from the flow start point to the flow end point when a 1 $cm^3$ sample was melted under conditions of die pore size of 1 mm diameter by 1 mm length, pressure of 20 $kg/cm^2$, and temperature rise rate of 6° C./min. The glass transition temperature was measured using a differential scanning calorimeter(model DCS-200; Seiko Denshi) and alumina as a reference; a 10 mg sample was heated from 20°~120° C. with a temperature rise rate of 10° C./min, and the shoulder value at the main endothermic peak was designated the glass transition temperature.

EXAMPLE 1

A mixture of 50 pbw polyester resin L1, 50 pbw polyester resin H1, 1 pbw polyethylene wax (800P; Mitsui Sekiyu Kagaku Kogyo; melt viscosity 5400 cps at 160° C., softening point: 140° C.), 2 pbw polypropylene wax (TS-200;

Sanyo Kasei Kogyo; melt viscosity of 120 cps at 160° C., softening point: 145° C. acid value: 3.5 KOHmg/g), 8 pbw carbon black (Mogul L; Cabot; pH2.5, mean primary particle size: 24 nm), and 2 pbw negative charge controller having the chemical structural formula below

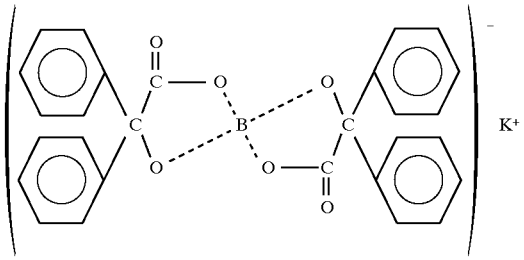

were added to a Henschel mixer and thoroughly mixed. The obtained mixture was fusion kneaded using a twin-shaft extrusion kneader, then cooled. The cooled mixture was coarsely pulverized using a hammer mill, and the coarsely pulverized material was finely pulverized using a jet mill, and then the material was then classified to obtain toner particles having a volume-average particle size of 7.5 $\mu$m.

These toner particles were mixed with 0.4 percent-by-weight hydrophobic silica microparticles having a BET specific surface area of 140 $m^2/g$ (H2000; Hoechst), and 0.2 percent-by-weight hydrophobic titanium dioxide microparticles having a BET specific surface area of 110 $m^2/g$ (STT30A; Chitan Kogyo) to obtain the end toner.

EXAMPLE 2

Toner was produced in the same manner as in Example 1 with the exception that 40 pbw of polyester resin L1 and 60 pbw polyester resin H1 were used.

EXAMPLE 3

Toner was produced in the same manner as in Example 1 with the exception that 30 pbw of polyester resin L1 and 70 pbw polyester resin H1 were used.

Reference Example 1

Toner was produced in the same manner as in Example 1 with the exception that 65 pbw of polyester resin L2 was used in place of polyester resin L1, and 35 pbw polyester resin H2 was used in place of polyester resin H1.

Reference Example 2

Toner was produced in the same manner as in Example 2 with the exception that iron-containing azo dye T77 (Hodogaya Chemical Co., Ltd.) was used as a negative charge controller.

Reference Example 3

Toner was produced in the same manner as in Example 2 with the exception that calix arene compound E89 (Orient Chemical Industries, Ltd.) was used as a negative charge controller.

Reference Example 4

Toner was produced in the same manner as in Example 2 with the exception that fluoride-containing quaternary ammonium salt VP434 (Hoechst) was used as a negative charge controller.

Reference Example 5

Toner was produced in the same manner as in Example 2 with the exception that terpene diphenol compound YP90 (Yasuhara Chemicals) was used as a negative charge controller.

Figure 2:
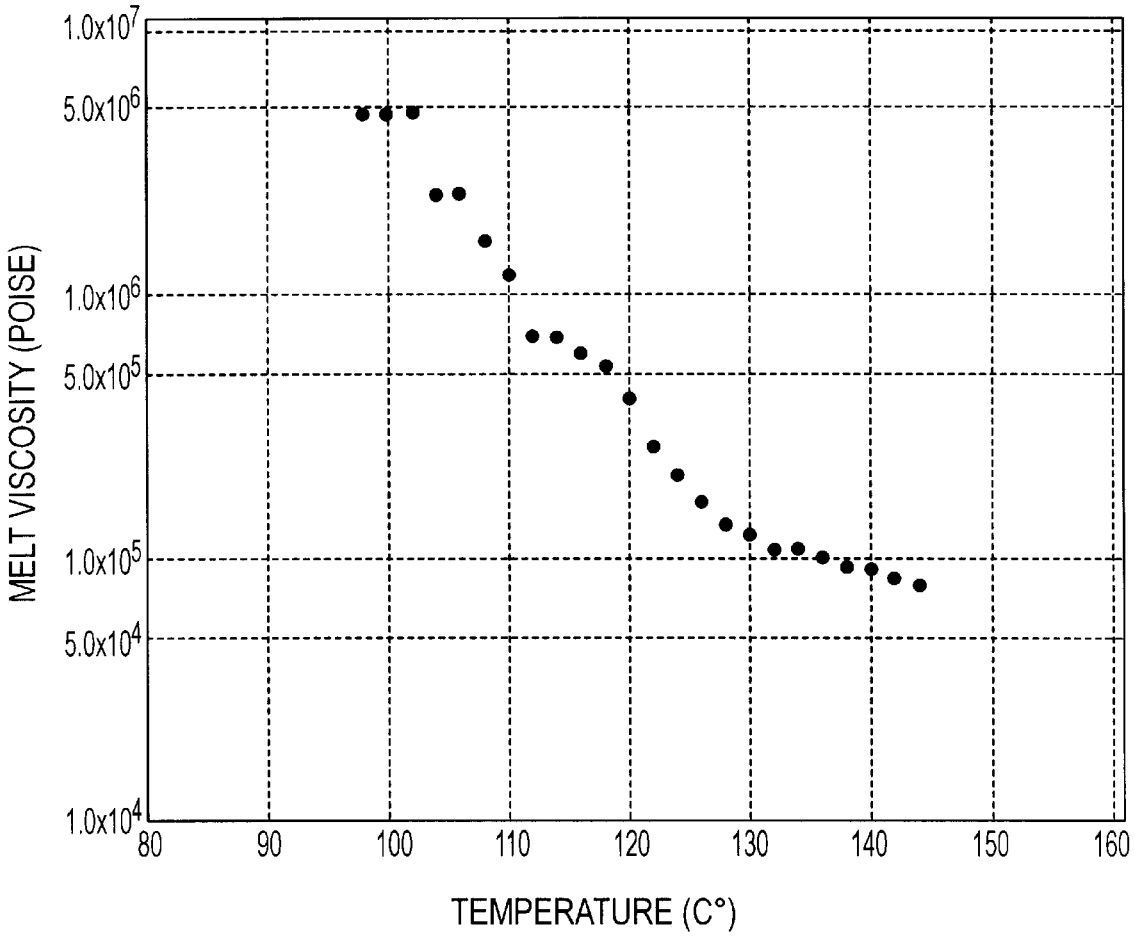
FIG. 2 shows the melt viscosity curve of a second embodiment of the toner.
Figure 3:
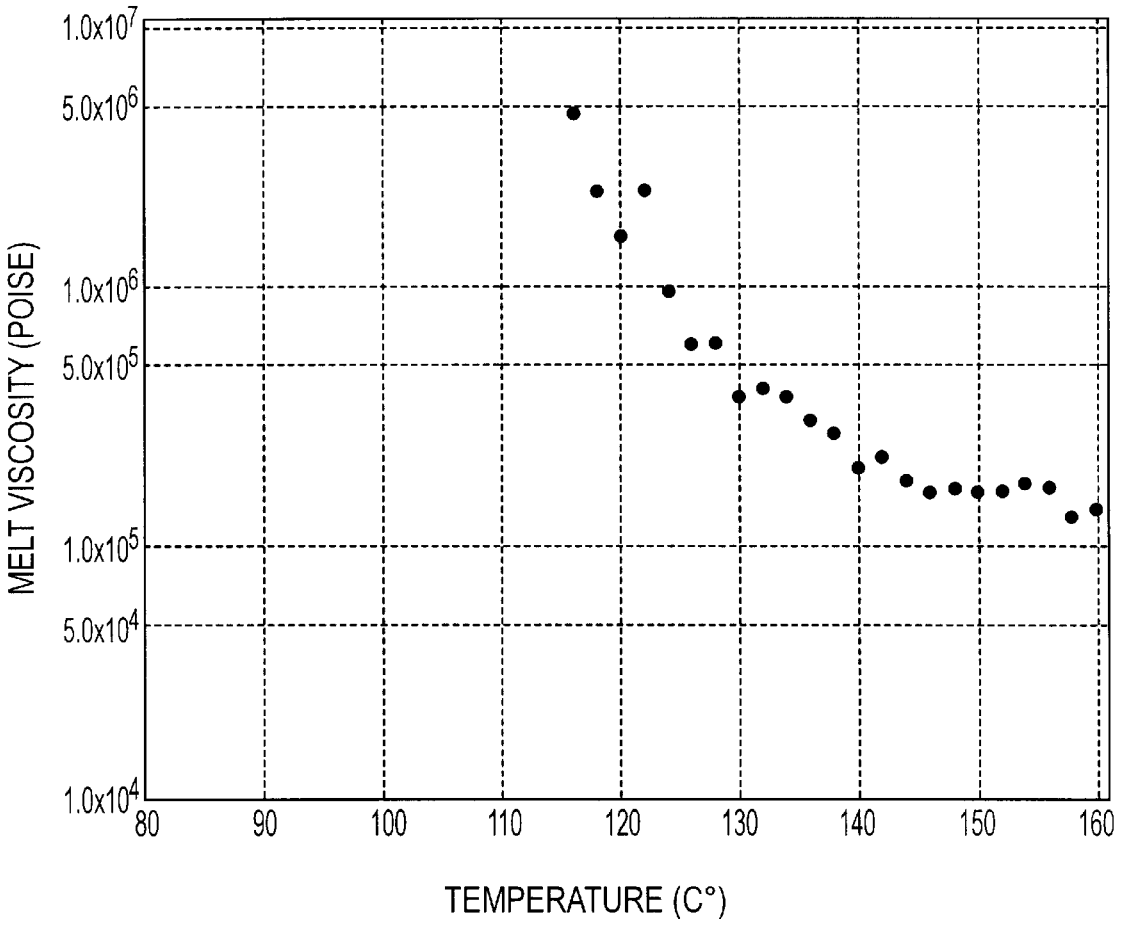
FIG. 3 shows the melt viscosity curve of a third embodiment of the toner.
Figure 4:
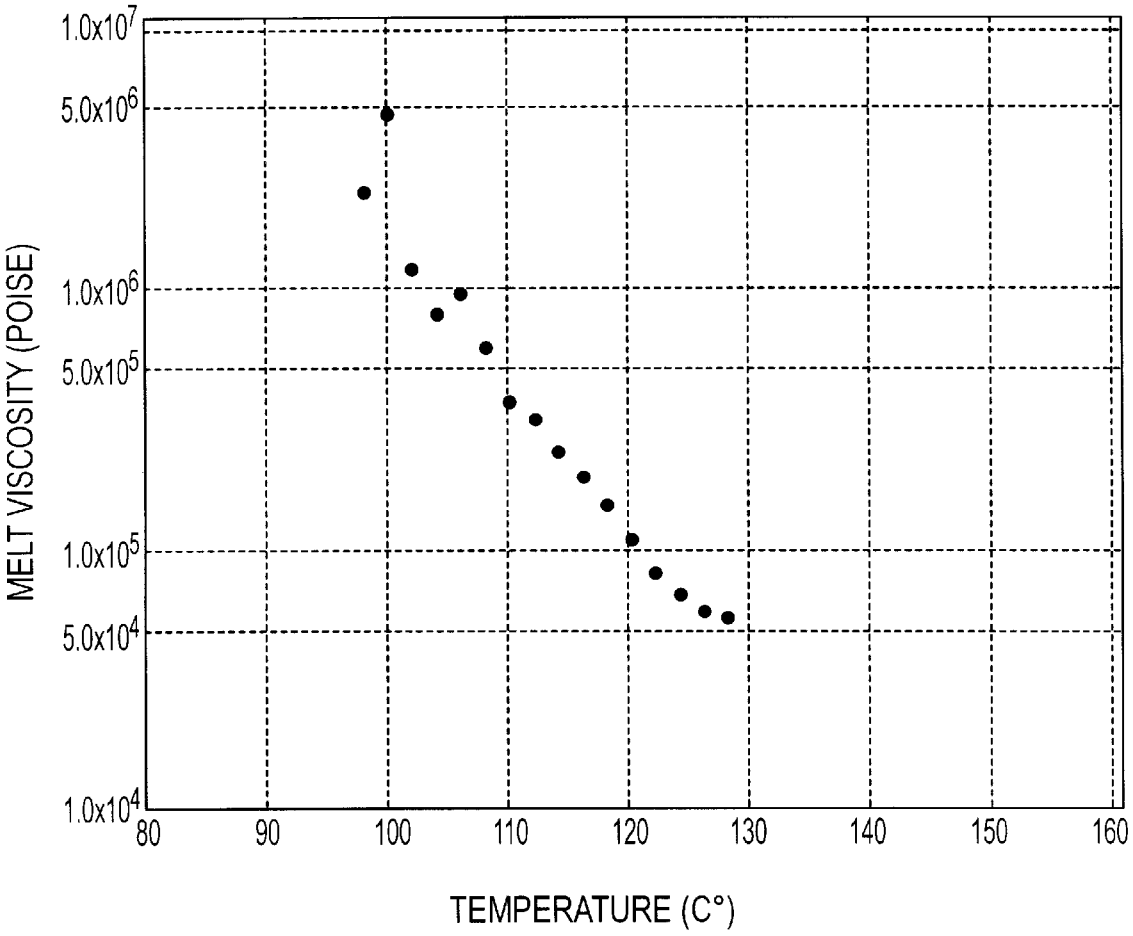
FIG. 4 shows the melt viscosity curve of a reference example 1.

Melt viscosity curves were determined for the toner particles of Examples 1~3 and Reference Example 1 using a flow tester (model CFT-500; Shimazu Seisakusho), with a melt flow of a 1 $cm^3$ sample under conditions of die pore 1 mm diameter by 1 mm length, 10 $kg/cm^2$ pressure, and temperature elevation rate of 3° C./min. The melt viscosity curves are shown in FIGS. 1~4. Melt viscosity curves for the toner particles of Reference Examples 2~6 were identical to that of Example 2. From these melt viscosity curves were determined the flow start temperature $T_1$, inflection temperature $T_2$, and flow end temperature $T_3$, the mean viscosity slope $\Delta\eta_1$ in the low temperature range below the inflection point, the mean viscosity slope $\Delta\eta_2$ in the high temperature range above the inflection point, the melt viscosity $\eta_2$ at the inflection temperature, and the melt viscosity $\eta_3$ at the flow end temperature; results are shown in Table 1. Since the toner of Reference Example 1 had no inflection point, the mean viscosity slope of the overall melt viscosity curve is shown in Table 1.

TABLE 1

| | $T_1$ (°C.) | $T_2$ (°C.) | $T_3$ (°C.) | Mean Viscosity Slope $\Delta\eta_1$ | Mean Viscosity Slope $\Delta\eta_2$ | $\eta_2$ (poise) | $\eta_3$ (poise) |
|---|---|---|---|---|---|---|---|
| Ex 1 | 102 | 130 | 140 | $4.67 \times 10^{-2}$ | $1.09 \times 10^{-2}$ | $9.824 \times 10^4$ | $7.640 \times 10^4$ |
| Ex 2 | 103 | 132 | 144 | $5.13 \times 10^{-2}$ | $1.12 \times 10^{-2}$ | $1.094 \times 10^5$ | $8.023 \times 10^4$ |
| Ex 3 | 109 | 146 | 160 | $4.20 \times 10^{-2}$ | $4.78 \times 10^{-3}$ | $1.604 \times 10^5$ | $1.375 \times 10^5$ |
| Ref 1 | 99 | — | 128 | $6.58 \times 10^{-2}$ | | — | $5.470 \times 10^4$ |

Each of the aforesaid toners were mixed with a carrier at a toner-to-carrier weight ratio of 5:95 to produce developer which was used in a digital copier (model Di30; Minolta Co., Ltd.). The toners were evaluated and the evaluation results are shown in Table 2.

Image blackness

Using the mode Di30 digital copier, solid images (2×2 cm) having 1.0 $mg/cm^2$ toner adhesion were formed, and the formed images were visually inspected. Excellent blackness was ranked O, slight irregularity when light was transmitted through the sheet but which posed no practical problem was ranked Δ, and weak color even without light transmission through the sheet was ranked X.

Anti-offset Characteristics

Solid images (2×5 cm) with an image density of 1.4 were formed while the fixing temperature was sequentially varied using a digital copier model Di30 modified with a fixing device which allowed variable fixing temperatures. The obtained images were visually examined and the temperatures at which low-temperature offset and high-temperature offset occurred were noted. A low-temperature offset temperature of less than 135° C. was ranked O, 135° C. and higher but less than 145° C. was ranked Δ, and above 145° C. was ranked X. A high temperature offset temperature of 240° C. or higher was ranked O, 230° C. and higher but less than 240° C. was ranked Δ, and less than 230° C. was ranked X.

Dot Reproducibility

Dot images of 2×2 dots (400 dpi) were formed using a modified model Di30 digital copier with the fixing roller temperature set at 180° C. The dot image diameter of obtained dot images was measured using an image analysis device to produce data for about 80~100 dots to determine the maximum diameter value D. Rankings are described below. Dmax of less than 185 μm was designated rank 10, 185 μm and higher but less than 187.5 μm was designated rank 9, 197.5 μm and higher but less than 190 μm was designated rank 8, 190 μm and higher but less than 102.5 μm was designated rank 7, 192.5 μm and higher but less than 105 μm was designated rank 6, 195 μm and higher but less than 107.5 was designated rank 5. Ranks 9 and 10 are expressed by O, ranks 7 and 8 are expressed by Δ, and ranks 6 and below are expressed by X.

Charge Rise Characteristics

Each of the aforesaid developers was loaded in a plastic bottle and rotated at 120 rpm on a ball mill table to mix for 5, 10, 30, 60, 120, and 780 minutes, after which the amount of charge was measured (under environmental conditions of 25° C., 45% relative humidity).

The amount of charge after 5 min relative to a maximum charge value {(amount of charge after 5 min/maximum charge value)×10} of 90% or greater was deemed an extraordinary excellent charge rise and designated by a rank of O, 80% and higher but less than 90% was deemed suitable for practical use and designated by a rank of Δ, and less than 80% was deemed unsuitable for practical use and designated by a rank of X.

TABLE 2

| | Image Blackness | Dot Reproducibility | High Temp Offset | Low Temp Offset | Charge Rise |
|---|---|---|---|---|---|
| Ex 1 | Δ | ○ | Δ | ○ | ○ |
| Ex 2 | ○ | ○ | ○ | ○ | ○ |
| Ex 3 | ○ | ○ | ○ | Δ | ○ |
| Ref 1 | Δ | Δ | X | Δ | ○ |
| Ref 2 | ○ | ○ | ○ | ○ | X |
| Ref 3 | ○ | ○ | ○ | ○ | X |
| Ref 4 | ○ | ○ | ○ | ○ | X |
| Ref 5 | ○ | ○ | ○ | ○ | X |

What is claimed is:

1. A negatively chargeable toner for developing electrostatic latent images comprising:

a binder resin;

a carbon black, and a boron compound represented by a structural formula (A),

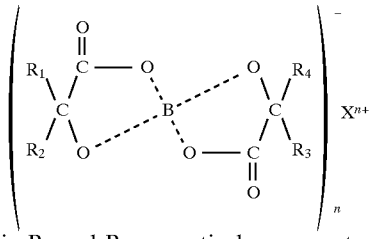

(A)

wherein $R_1$ and $R_3$ respectively represent substituted or non-substituted aryl group, $R_2$ and $R_4$ respectively represent hydrogen atom, alkyl group, substituted or non-substituted aryl group, X represents a cation, and n represents an integer of either 1 or 2;

wherein a melt viscosity curve of said negatively chargeable toner has an inflection point of a viscosity slope, an inflection point temperature ($T_2$) existing within a temperature range of $T_1$+20° C. to $T_1$+40° C. relative to a flow start temperature ($T_1$), a first absolute value ($\Delta\eta_1$) existing within a range of $4.0\times10^{-2}$ to $6.0\times10^{-2}$, said first absolute value ($\Delta\eta_1$) being a mean viscosity slope within a temperature range below the inflection point temperature ($T_2$), a second absolute value ($\Delta\eta_2$) existing less than $2.0\times10^{-2}$, said second absolute value ($\Delta\eta_2$) being a mean viscosity slope within a temperature range higher than said inflection point temperature ($T_2$), and a temperature difference between said inflection point temperature ($T_2$) and a flow stop temperature ($T_3$) being 5° C. or more.

2. The negatively chargeable toner of claim 1, wherein a first melt viscosity of said inflection point temperature ($T_2$) exists within a range of $7.5\times10^4$ to $5.0\times10^5$ poise.

3. The negatively chargeable toner of claim 1, wherein a second melt viscosity within a temperature range higher than said inflection point temperature ($T_2$) exists within a range of $5.0\times10^4$ to $2.0\times10^5$ poise.

4. The negatively chargeable toner of claim 1, wherein a first melt viscosity of said inflection point temperature ($T_2$) exists within a range of $8.0\times10^4$ to $3.0\times10^5$ poise and a second melt viscosity within a temperature range higher than said inflection point temperature ($T_2$) exists within a range of $7.5\times10^4$ to $1.5\times10^5$ poise.

5. The negatively chargeable toner of claim 1, wherein an amount of the carbon black is from 6 to 12 parts by weight per 100 parts by weight of the binder resin.

6. The negatively chargeable toner of claim 5, wherein the carbon black has a mean primary particle size of 40 nm or less.

7. The negatively chargeable toner of claim 5, wherein the carbon black has a pH value of 1 to 6.

8. The negatively chargeable toner of claim 1, wherein the binder resin has an acid value of 5 to 50 KOHmg/g.

9. The negatively chargeable toner of claim 8, wherein the binder resin comprises a polyester resin obtained by a polyvalent alcohol component and a polyvalent carboxylic acid component.

10. The negatively chargeable toner of claim 8, wherein the binder resin comprises a polyester resin and a vinyl resin.

11. The negatively chargeable toner of claim 10, wherein the binder resin is obtained by a raw monomer of the polyester resin, a raw monomer of the vinyl resin and a dual-reactive monomer, said dual-reactive monomer being able to use dual reactions of a condensation polymerization and a radical polymerization.

12. The negatively chargeable toner of claim 11, wherein the dual-reactive monomer has a carboxyl group and a vinyl group.

13. The negatively chargeable toner of claim 1, wherein an amount of the boron compound is from 0.5 to 5 parts by weight per 100 parts by weight of the binder resin.

14. The negatively chargeable toner of claim 1, comprising a wax being contained in an amount of 0.5 to 5 parts by weight per 100 parts by weight of the binder resin.

15. The negatively chargeable toner of claim 14, wherein the wax is both a polypropylene wax and a polyethylene wax.

16. A negatively chargeable toner for developing electrostatic latent images comprising:

a binder resin;

a carbon black, and a boron compound being colorless or white in color, inflection point of a viscosity slope, an inflection point temperature ($T_2$) existing within a temperature range of $T_1$+20° C. to $T_1$+40° C. relative to a flow start temperature ($T_1$), a first absolute value ($\Delta\eta_1$) existing within a range of $4.0\times10^{-2}$ to $6.0\times10^{-2}$, said first absolute value ($\Delta\eta_1$) being a mean viscosity slope within a temperature range below the inflection point temperature ($T_2$), a second absolute value ($\Delta\eta_2$) existing less than $2.0\times10^{-2}$, said second absolute value ($\Delta\eta_2$) being a mean viscosity slope within a temperature range higher than said inflection point temperature ($T_2$), and a temperature difference between said inflection point temperature ($T_2$) and a flow stop temperature ($T_3$) being 5° C. or more.

17. The negatively chargeable toner of claim 16, wherein a first melt viscosity of said inflection point temperature ($T_2$) exists within a range of $7.5\times10^4$ to $5.0\times10^5$ poise.

18. The negatively chargeable toner of claim 16, wherein a second melt viscosity within a temperature range higher than said inflection point temperature ($T_2$) exists within a range of $5.0\times10^4$ to $2.0\times10^5$.

19. The negatively chargeable toner of claim 16, wherein the carbon black has a mean primary particle size of 40 nm or less, and an amount of the carbon black being from 6 to 12 parts by weight per 100 parts by weight of the binder resin.

20. The negatively chargeable toner of claim 19, wherein the carbon black has a pH value of 1 to 6.

21. The negatively chargeable toner of claim 16, wherein the binder resin has an acid value of 5 to 50 KOHmg/g.

22. A negatively chargeable toner for developing electrostatic latent images:

a binder resin;

a carbon black, and a boron compound represented by a structural formula (A),

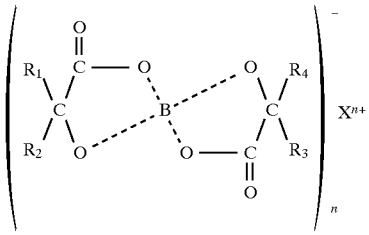

(A)

wherein $R_1$ and $R_3$ respectively represent substituted or non-substituted aryl group, $R_2$ and $R_4$ respectively represent hydrogen atom, alkyl group, substituted or non-substituted aryl group, X represents a cation, and n represents an integer of either 1 or 2;

wherein a melt viscosity curve of said negatively chargeable toner has an inflection point of a viscosity slope, an inflection point temperature ($T_2$) existing within a temperature range of $T_1$+20° C. to $T_1$+40° C. relative to a flow start temperature ($T_1$), a first melt viscosity of said inflection point temperature ($T_2$) existing within a range of $7.5\times10^4$ to $5.0\times10^5$ poise, a second melt viscosity within a temperature range higher than said inflection point temperature ($T_2$) existing within a range of $5.0\times10^4$ to $2.0\times10^5$ poise and a temperature difference between said inflection point temperature ($T_2$) and a flow stop temperature ($T_3$) being 5° C. or more.

23. The negatively chargeable toner of claim 22, wherein the first melt viscosity of said inflection point temperature ($T_2$) exists within a range of $8.0\times10^4$ to $3.0\times10^5$ poise, and the second melt viscosity within a temperature range higher than said inflection point temperature ($T_2$) exists within a range of $7.5\times10^4$ to $1.5\times10^5$ poise.

24. The negatively chargeable toner of claim 22, wherein the temperature difference between said inflection point temperature ($T_2$) and a flow stop temperature ($T_3$) is 8° C. or more.

25. The negatively chargeable toner of claim 22, wherein the carbon black has a mean primary particle size of 40 nm or less, and an amount of the carbon black being from 6 to 12 parts by weight per 100 parts by weight of the binder resin.

26. The negatively chargeable toner of claim 25, wherein the carbon black has a pH value of 1 to 6.

27. The negatively chargeable toner of claim 22, wherein the binder resin has an acid value of 5 to 50 KoHmg/g.

* * * * *